US005299175A

United States Patent [19]

Gallego-Juarez et al.

[11] Patent Number: 5,299,175

[45] Date of Patent: Mar. 29, 1994

[54] ELECTROACOUSTIC UNIT FOR GENERATING HIGH SONIC AND ULTRA-SONIC INTENSITIES IN GASES AND INTERPHASES

[75] Inventors: Juan A. Gallego-Juarez; German Rodriguez Corral, both of Madrid; Jose L. San Emetero Prieto, Pozuelo de Alarcon; Fausto Montoya Vitini, Madrid, all of Spain

[73] Assignee: Consejo Superior de Investigaciones Cientificas, Madrid, Spain

[21] Appl. No.: 6,040

[22] Filed: Jan. 19, 1993

Related U.S. Application Data

[63] Continuation of Ser. No. 928,630, Aug. 12, 1992, abandoned, which is a continuation of Ser. No. 720,176, filed as PCT/ES90/00033, Oct. 3, 1990, abandoned.

[30] Foreign Application Priority Data

Oct. 6, 1989 [ES] Spain ..... 8903371

[51] Int. Cl.[5] ..... G10K 13/00; B06B 1/02; B06B 3/04

[52] U.S. Cl. ..... 367/138; 367/158

[58] Field of Search ..... 367/137, 138, 150, 152, 367/158, 97; 310/323, 328, 334

[56] References Cited

U.S. PATENT DOCUMENTS 4,779,243 10/1988 West .
4,868,445 9/1989 Wand .
5,050,137 9/1991 Sato et al. ..... 367/150

FOREIGN PATENT DOCUMENTS 0327486 8/1989 European Pat. Off. .
8602058 4/1986 PCT Int'l Appl. .
459487 6/1977 Spain .
542694 4/1985 Spain .

OTHER PUBLICATIONS

"Transductor piezoelectrico para la generacion de ultrasonidos en el aire" J. A. Gallego Juarez & G. Rodriguez Corral in Revista de Acustica, vol. IV, No. 1-2; 1973; pp. 35-37.

"Ultrasonic Generators for Low and High-Power Applications in Gases"; 1981 G. Rodriguez et al. in Ultrasonics International 1981.

"An Ultrasonic transducer for high power applications in gases" J. A. Gallego Juarez et al in Ultrasonics, IPC Business Press; Nov. 1978; pp. 267-272.

"Ultrasonics International 89 Conference Proceedings", 1989; pp 250-256 G. Rodriguez et al.

Ultrasonics International 85, London Jul. 2-4, 1985, Conference Proceedings, G. Rodriquez et al: "High Power Ultrasonic Equipment for Industrial Defoaming":, pp. 506-511.

Ultrasonics International 87, London Jul. 6-9, 1987, Conference Proceedings, G. Rodriguez-Corral et al.: "Focused High-Power Ultrasonic Transducer With Stepped-Plate Radiator for Industrial Applications in Gases", pp. 794-799.

*Primary Examiner*—Daniel T. Pihulic
*Attorney, Agent, or Firm*—Darby & Darby

[57] ABSTRACT

New electroacoustic unit for efficient generation of high sonic and ultrasonic intensities in gas media and in interphases (gas-solid, gas-liquid.) Said unit is comprised of an electromechanical transducer system of which the radiating element is a plate (3) having a discontinuous profile and an electronic device for the controlled generation of the electric power signal. The unit is capable of generating acoustic fields of very high intensity with a predetermined configuration. Particularly it is capable of generating with a same transducer system two distinct configurations of the acoustic field. Prototypes for generating directional and focused fields have been developed.

30 Claims, 4 Drawing Sheets

ELECTROACOUSTIC UNIT FOR GENERATING HIGH SONIC AND ULTRA-SONIC INTENSITIES IN GASES AND INTERPHASES

This is a continuation of application Ser. No. 07/928,630, filed Aug. 12, 1992, now abandoned, which is a continuation of Ser. No. 07/720,176, filed as PCT/ES90/00033, Oct. 3, 1990, now abandoned.

The object of this patent is an electroacoustic unit for efficient generating of high acoustic intensities in gas media and in interphases (gas-solid, gas-liquid.)

Generating high intensity ultrasonic sonic waves in gases involves outstanding difficulties that are basically connected to the low acoustic impedance of the medium (product of the intensity by the propagation velocity) and the high absorption of the same. Therefore, in order to obtain efficient transmitting of acoustic energy a good coupling between the transmitting system and the gas is necessary. Besides, in order to reach high intensities high vibration amplitudes are required and the acoustic beam must be very directional or focalized.

There are different types of sonic and ultrasonic generators for use in gases. Most of them are aerodynamic systems, such as whistles and sirens, in which the energy is supplied by a stream of gas. The acoustic powers reached with these systems may be high, however, the yields that are obtained are generally low. Acoustic signals transmitted are complex and have difficulties in reaching ultrasonic frequencies. Besides, aerodynamic systems have the disadvantage that, along with acoustic radiation, a large amount of gas coming from the transmitter is propagated.

Other high intensity acoustic wave generators are of the electromagnetic, magnetostrictive or piezoelectric type, working with solid transmitters vibrating longitudinally whereby they have outstanding limitations in geometry (to prevent transversal modes), as well as to attain high yields and high displacements. The most recent attempts try to use flat radiators vibrating flexionally. This makes it possible to increase the radiating surface, increasing the radiation impedance (which is proportional to the radiator surface), and attain high displacements. However, the big problem of these systems comes from the phase cancellation that is produced as a result of the areas that vibrate in counterphase on both sides of a nodal line. There are some attempts to avoid this effect by covering those internodal areas that vibrate with the same phase with absorbent materials and leaving the alternate areas that vibrate in phase opposition to the previous ones free. Other more effective structures try to take advantage of all the vibrating areas by covering the internodal areas with materials that serve as medium impedance adaptors and with a thickness such that it is possible to correct in the radiation the phase displacement that is produced in vibration. These systems, though they are more effective than the above cited ones, have outstanding practical problems coming from the connections between the flat plate and the additional materials that are placed on the internodal area.

The present invention refers to an electroacoustic unit that consists of a transducer system and an electronic feed device. In the transducer system which may be piezoelectric or magnetostrictive, the radiating element is a flexional type, but it has a structure having a discontinuous profile. With this special design, the vibration amplitude and the radiation phase are modified in such a way that all the vibrating areas directly contribute to the construction of the acoustic field with a configuration that may be predetermined. Besides, with the same radiating-element it is possible to obtain two different configurations of the acoustic field, in correspondence with the different profile of each one of the surfaces of the same. Particularly prototypes for frequencies of approximately 20 KHz have been developed which achieves, with a single transducer, a directional field of a beam width (at 3 db) less than 3 degrees by one of the surfaces of the radiatingelement and a strongly focalized field in an axial cylindric volume some 10 cm. long and less than 2 cm. wide on the other surface.

BRIEF DESCRIPTION OF THE DRAWINGS

FIG. 1 shows the directivity diagram of the transducer radiating at its directional surface, while FIG. 2 shows the axial and transversal distribution (in the focus) of the acoustic field transmitted by the focalizing surface. P represents the acoustic pressure amplitude and D the distance in centimeters.

Figure 1:
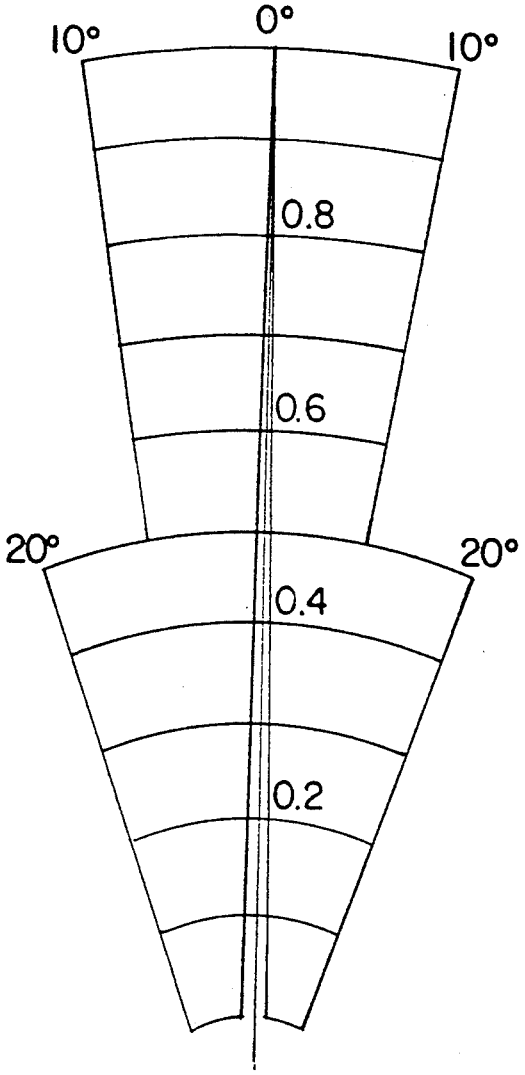
FIG. 1 shows the directivity diagram of the transducer radiating at its directional surface.
Figure 2B:
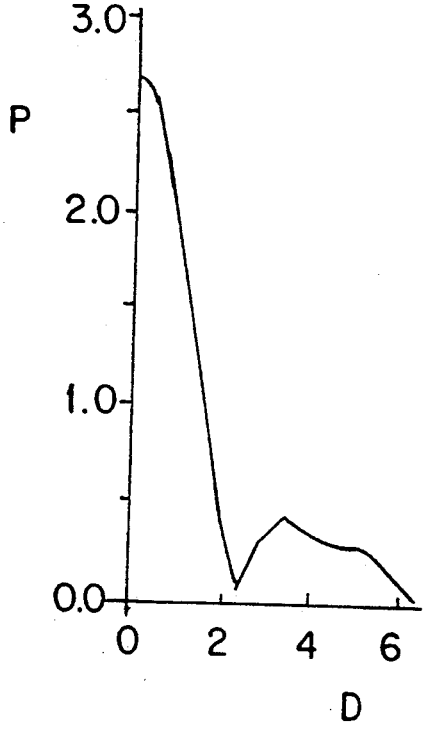
FIGS. 2(*a*) and 2(*b*) show the axial and transversal distribution of the acoustic field transmitted by the focalizing surface.
Figure 2A:
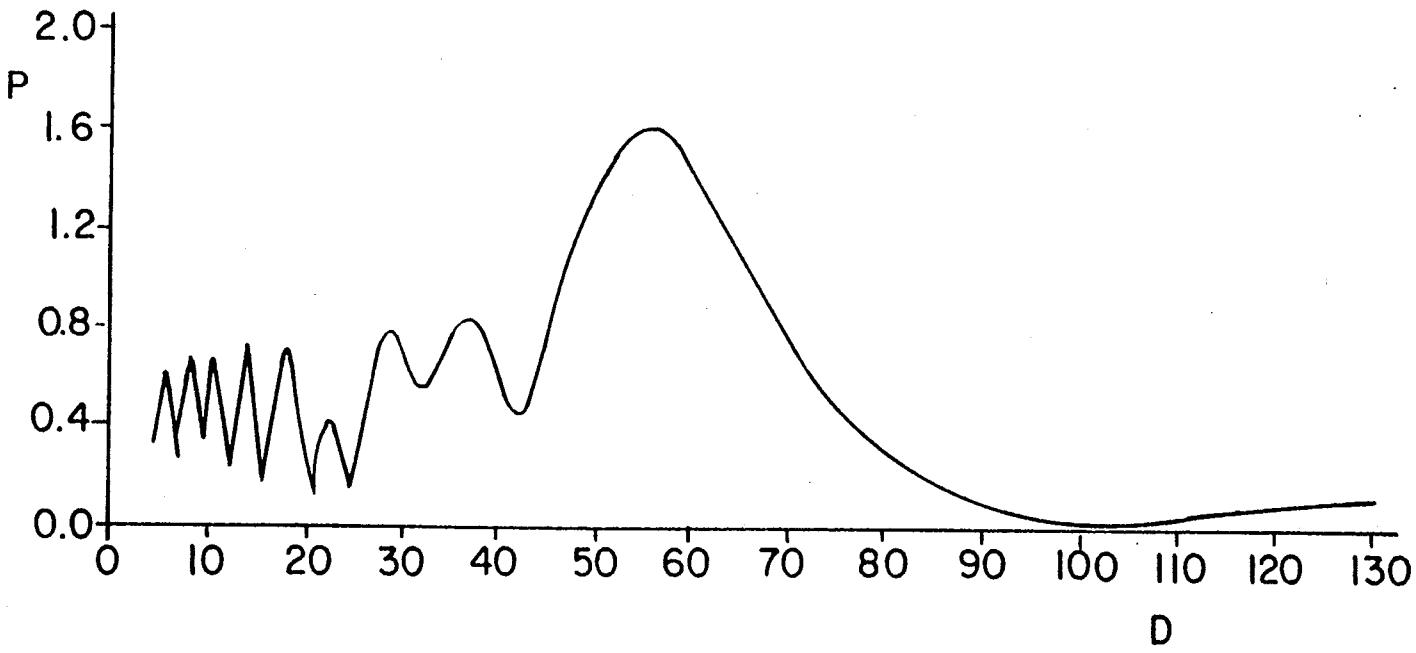
Figure 3:
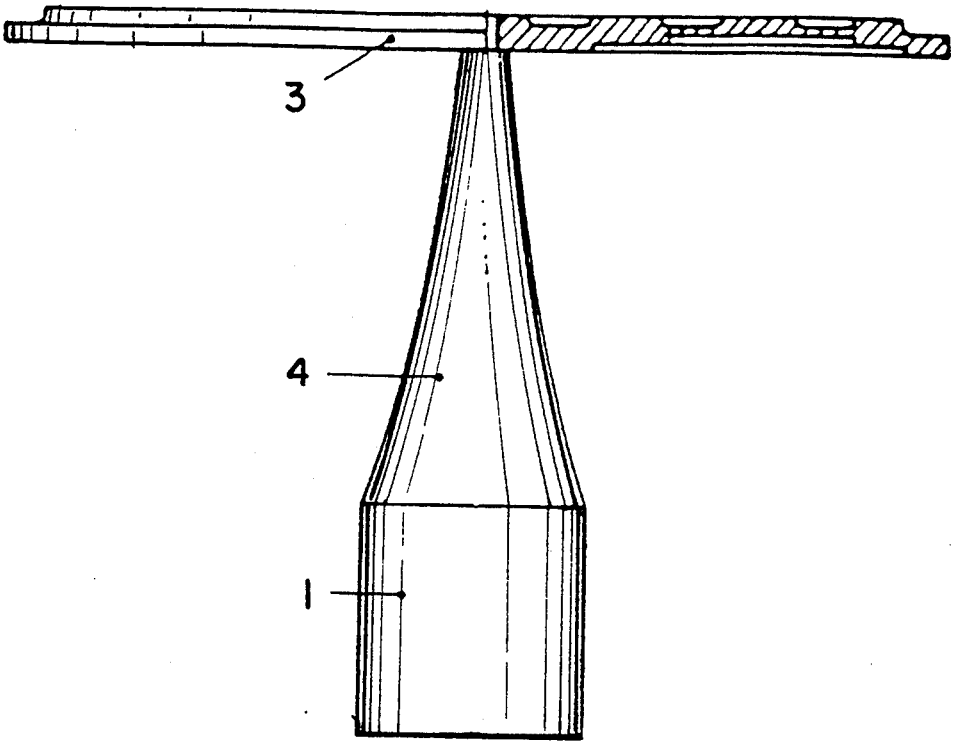
FIG. 3 shows the transducer system of the present invention.

The transducer system (FIG. 3) consists essentially of a transducer element (1) that can be piezoelectric or magnetostrictive, a mechanical vibration amplifier (2), which may be exponential, stepped, conical or catenoid, and a radiator which is a plate having a discontinuous profile on the two surfaces (3) thereof. The longitudinal vibration generated by the transducer element and amplifed by the mechanical amplifier, serves to excite the radiating element in one of its flexional modes. Although in general it is useful to use circular shapes and axysymmetric modes, obtaining directional fields is achieved by displacing alternatively internodal crows in medium radiation wave length in the medium, for the purpose of putting the entire beam in phase. Likewise, focalized fields are obtained by displacing the internodal crows in such a way that the distance from the center of said areas to the focal point is such that the radiation arrives in phase said point situated in the field close to the radiator. It is obvious that by varying the length of displacement of the internodal crowns adequately practically any distribution of the acoustic field that is desired can be achieved.

The construction of radiators with a double discontinuous profile, aside from the usefulness that is represented by having two configurations of the acoustic field, favors in general lines a more homogeneous distribution of the vibration amplitudes, in comparison with a flat radiator, as a result of the mass distribution. This results in a greater power capacity of the transducer systems which, in the structure that is presented here, is produced by the maximum vibration amplitude which the radiator can develop without breaking. For this purpose the radiators that are presented here must be made out of metals or metal alloys which, like the ones of titanium, have good vibratory features and high mechanical resistance.

In order to obtain a maximum yield in the transducer system, the three basic parts that form it have to be well tuned to the work frequency. As a result, the system turns out to be highly resonant and, given that the conditions of the medium or by heating the frequency can vary with time, an electronic excitation device with very specific requirements is necessary.

Therefore, the generating system, aside from producing in each instant a signal whose frequency is situated within a very narrow band (corresponding to the resonance margin of the transmitter used), it is capable of automatically correcting the value of said frequency by adapting it to the slipping produced in the resonance band of the transmitter, as the reactive mechanical load associated to the latter varies for different conditions of the radiated medium and of the transmitter device itself.

The presently used systems for excitation of this type of transducer are based on analogic type oscillator assemblies, formed by a power amplifier refed by the ultrasonic transducer itself by means of a tuned bridge circuit, a phase shifter, a limiter and a band pass filter. This type of system has a rather critical performance above all in the initial instants of transmission, also requiring the use of components having a very high precision, as well as including several adjustment points, that have to be adjusted individually for each different ultrasonic transmitter that is connected.

The generator object of the present patent introduces a new process for following up the resonance frequency of the transmitter, which does not need the transducer to be introduced in the refeed loop of the oscillating circuit.

The process is based on the fact that a sonic or ultrasonic transmitter of the piezoelectric type has a purely resistive electric impedance when it vibrates in the central point of its resonance band (assuming that there has been a compensation of the reactive component associated with the interelectrodic capacity of the transducer.) When the operating point moves away (though slightly) from the resonance, a considerable reactive component rapidly appears. As a result thereof, only the voltage and intensity signals in the transducer will have a negative phase displacement at the resonance frequency.

Therefore, it will suffice that the generator accommodates the frequency of the signal at the point in which said phase displacement is cancelled so that resonance is produced.

This method presents a series of advantages over the above cited ones:

a) It is not necessary to introduce the transducer in the refeed chain of the system, which leads to a greater stability of the amplitude of the exciting signal.

b) The manufacturing of the electronic device does not require the use of high precision components.

c) Finally, the operating of the system in the resonance points turns out to be very stable, adapting accurately to the band slippings caused by variations of the features of the medium in which the transmitter radiates.

Sonic and ultrasonic transducers also have considerable resistance variations in terms of the temperature of the ceramics, which changes extensively during operation due to heating. The described system also includes a circuit which measures the power delivered by the transducer to the load and estabilization thereof.

Figure 4:
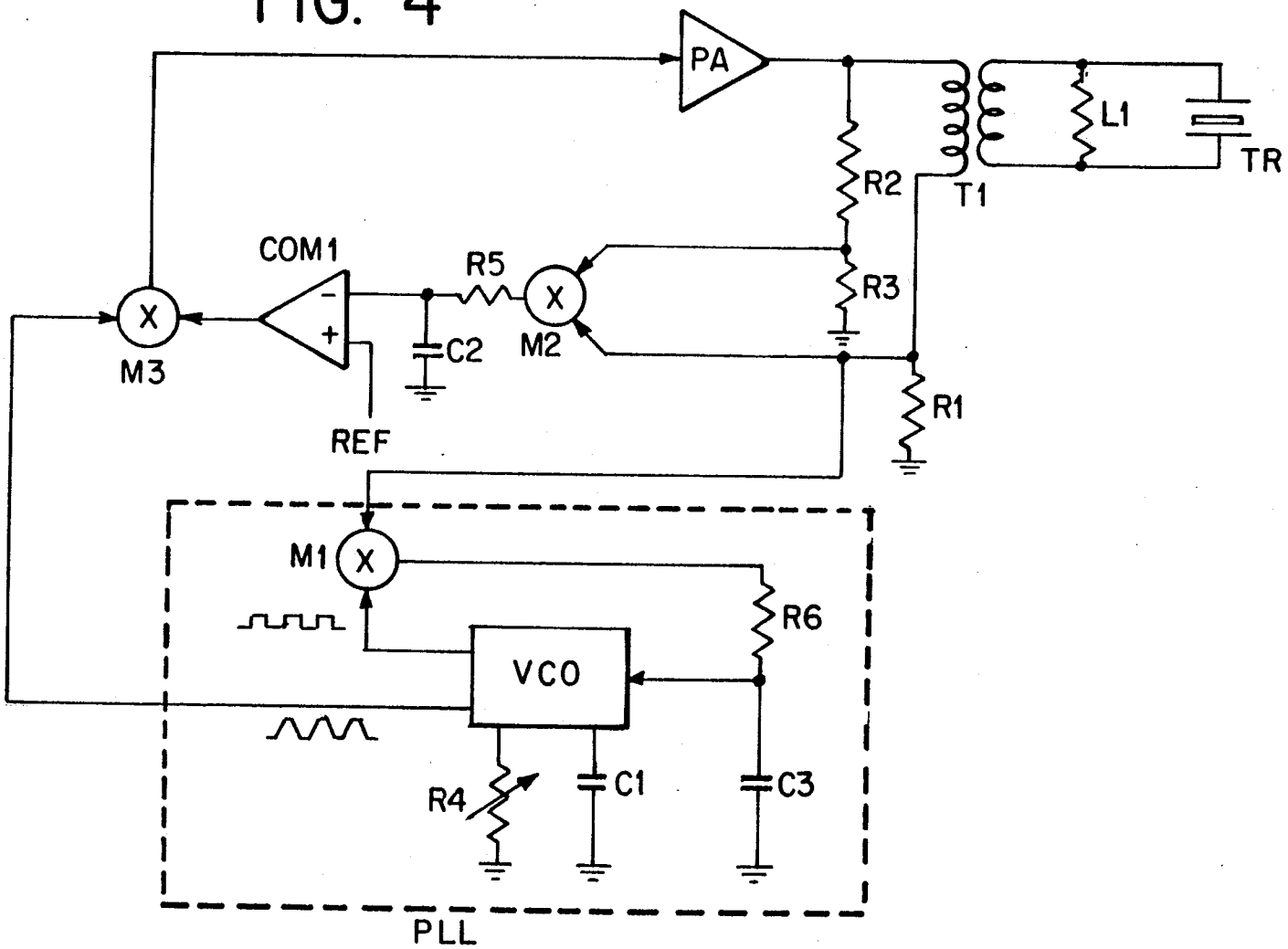
FIG. 4 shows a block diagram of the electroacoustic generating system of the present invention.

Just as is put forth in the block diagram of FIG. 4, the generating system consists of the following basic steps:

a) An impedance transformer that reduces the impedance of the transducer to 50 Ω.

b) A compensation reactor of the spurious capacity of the transducer.

c) A suitable power amplifier to excite loads of 50 Ω.

d) A channel to take a sample of the current signal in the load.

e) A channel to take a sample of the output voltage of the power amplifier.

f) A PLL (Phase Looked Loop) circuit to generate the exciting signal of the power amplifier, with a frequency equal to the resonance frequency of the transducer.

g) A circuit measuring the power delivered to the load.

h) A circuit controlling the power delivered to the load.

Hereinafter the operation of each one of these steps is described individually as well as their interrelationship.

a) Transformer T1 has a band much wider than the resonance frequency margin in which the transducer moves, introducing a negligible phase displacement. The transformation ratio is such that the impedance that the primary has is 50 Ω, when it is loaded with the cold transducer. The impedance of 50 Ω has been chosen to be able to adapt to the impedance of originay transmission lines of 50 Ω, which join the transformer and the amplifier. Depending on the use, it may be necessary that the transducer and main unit are very separated from each other, and therefore, they have to be joined by an adapted transmission line.

b) The compensation reactor L1 resonates at the work frequency of the transducer with the spurious electric capacity of the transducer, compensating the detrimental phase displacement that the latter could introduce.

c) the power amplifier is capable of delivering a power suitable to each use. The design thereof is common and it should be adapted to excite loads of 50 Ω. The phase displacement introduced between the input and output signals has to be null.

d) The channel for taking a sample of the current in the charge signal is formed by the resistor R1 which is located series connected with the load of the amplifier and which is of a value much less than 50 Ω, in such a way that it does not appreciably modify the load impedance and the voltage that appears in the terminals thereof is proportional to the current intensity in the load. The signal obtained serves to control the frequency as well as to control the power.

e) The channel for taking a sample of the output voltage of the power amplifier is formed by a voltage divider that takes a small fraction thereof, made out of resistors R2 and R3. The signal obtained serves to control the power.

The PLL (Phase Locked Loop) circuit is of a common type. It is made up of a VCO (voltage controlled oscillator), a four-quadrant multiplier acting as a M1 phase and low pass filter comparator, consisting of resistor R6 and condenser C3. The VCO has two outputs, one in the form of a square wave to attack the phase comparator and another in the form of a sinewave to attack the amplifier, both outputs are out of phase in $\pi/2$ radians. The other phase comparator input is the signal of sample of output current. The phase comparator is a four-quadrant multiplier in such a way that the PLL hooks up to the frequency at which the phase difference between the two pinputs is $\pi/2$, since the phase difference between the two VCO outputs is also $\pi/2$, it turns out that it will be maintained at the frequency at which the phase in which the voltage and current at the power amplifier outlet is O. The central work frequency of the VCO is adjusted by means of resistor R4 and condenser C1.

g) The circuit measuring the power delivered to the load is formed by a four-quadrant multiplier M2 whose inputs are the voltage and current samples taken at the outlet of the power amplifier, the product signal is filtered low pass by means of resistor R5 and condenser C2 in such a way that the filter output is proportional to the effective power in the load.

h) The circuit controllings the power delivered to the load consists of a comparator COM1 and a four-quadrant multiplier M3, functioning as an attentuator controlled by voltage. The comparator finds the difference of magnitude between the effective power in the load and a reference signal REF, the difference between them serves to control the attentuation introduced by the multiplier M2.

KEYS OF THE GRAPH

FIG. 4—A general block diagram of the electronic generator. It includes the transformation, power amplification, generation, automatic frequency control and power control steps.

We claim:

1. Electroacoustic unit for generating sonic and ultrasonic energy in gases and interphases consisting of an electromechanical transducer system and an electronic device for controlled generation of an electric power signal in which the electroacoustic unit comprises: a) a transducer system having a transducer element, a mechanical vibration amplifier and a radiator shaped like a plate having a discontinuous profile on both surfaces, said transducer element, said vibration amplifier and said radiator being tuned in order to resonate at a work frequency; and b) an electronic generator having a power amplifier, a PLL (Phase Locked Loop) circuit, a circuit measuring the power signal and a circuit controlling the power signal.

2. An electroacoustic unit according to claim 1 and characterized because the transducer element may be piezo-electric or magnetostrictive and causes a longitudinal vibration 3. An electroacoustic unit according to claim 2 characterized because the mechanical amplifier can be exponential, stepped conical, or catenoid and amplifies the vibration generated by the transducer element, exciting the radiator in one of its flexional modes of vibration.

4. An electroacoustic unit according to claim 3 and characterized because the radiating element is made up of a plate that may have any geometric shape (circular, rectangular, square) and whose two surfaces have a discontinuous profile, that is obtained by displacing in the direction perpendicular to the medium plane of the plate, some internodal areas.

5. An electroacoustic unit according to claim 4 and characterized because the number and position of the internodal areas that are displaced as well as the height or depth of the displacements depends on the configuration of the acoustic field that is desired.

6. An electroacoustic unit according to claim 5 and characterized because with a single radiator two acoustic fields can be generated with a different configuration, in correspondence with the two different profiles of each one of the surfaces.

7. An electroacoustic unit according to claim 6 and characterized because the obtaining of directional fields is achieved, in the case of circular radiators by vibrating in one of the axysymmetric modes thereof, alternately displacing the internodal crowns in average wave length of radiation in the medium.

8. An electroacoustic unit according to claim 7 and characterized because the obtaining of focalized fields is achieved, in the case of circular radiators by vibrating in one of the axysymmetric modes thereof, displacing the internodal crowns in such a way that the distance from the center of said areas to the focal point is such that the radiation arrives in phase said point situated in the field close to the radiator.

9. An electroacoustic unit according to claim 8 and characterized because the electronic generating device produces in each instant a signal whose frequency is situated within the resonance band of the transducer system, and automatically corrects the value of said frequency to adapt it to the slipping that can be produced in the resonance band of the transmitter.

10. An electroacoustic unit according to claim 9 and characterized because the electronic generator has a power amplifier in which the phase displacement introduced between the input and output signals is null.

11. An electroacoustic unit according to claim 10 and characterized because in the electronic generator the channel for taking the sample of the load current signal is formed by a resistor in series with the load of the amplifier with a value that does not appreciably modify the load impedance the voltage in the terminals thereof being proportional to the current intensity in the load.

12. An electroacoustic unit according to claim 11 and characterized because in the electronic generator a sample of the output voltage of the power amplifier is taken by means of a voltage divider to control the power.

13. An electroacoustic unit according to claim 12 and characterized because the electronic generator includes a PLL (Phase Locked Loop) circuit integrated by a voltage controlled oscillator, a four-quadrant multiplier acting as a phase and low pass filter comparator.

14. An electroacoustic unit according to claim 13 and characterized because the voltage controlled oscillator of the electronic generator has two outputs, one in the form of a square wave which attacks the phase comparator and another sinewave that attacks the amplifier both out of phase in $\pi/2$ radians, the other input of the phase comparator being the output current sample signal.

15. An electroacoustic unit according to claim 14 and characterized because in the electronic generator the circuit measuring the power delivered to the load is formed by a four-quadrant multiplier whose inputs are the voltage and current samples taken at the output of the power amplifier, the product signal being filtered for low pass to obtain a signal proportional to the effective power in the load.

16. An electroacoustic unit according to claim 15 and characterized because in the electronic generator, the circuit controlling the power delivered to the load is made up of a comparator and four quadrant multiplier, operating as an attenuator controlled by voltage.

17. An electroacoustic unit according to claim 1 characterized because the mechanical amplifier can be exponential, stepped conical, or catenoid and amplifies the vibration generated by the transducer element, exciting the radiator in one of its flexional modes of vibration.

18. An electroacoustic unit according to claim 1 and characterized because the radiating element is made up of a plate that may have any geometric shape (circular, rectangular, square) and whose two surfaces have a discontinuous profile, that is obtained by displacing in the direction perpendicular to the medium plane of the plate, some internodal areas.

19. An electroacoustic unit according to claim 1 and characterized because the number and position of the internodal areas that are displaced as well as the height or depth of the displacements depends on the configuration of the acoustic field that is desired.

20. An electroacoustic unit according to claim 1 and characterized because with a single radiator two acoustic fields can be generated with a different configuration, in correspondence with the two different profiles of each one of the surfaces.

21. An electroacoustic unit according to claim 1 and characterized because the obtaining of directional fields is achieved, in the case of circular radiators by vibrating in one of the axysymmetric modes thereof, alternately displacing the internodal crowns in average wave length of radiation in the medium.

22. An electroacoustic unit according to claim 1 and characterized because the obtaining of focalized fields is achieved, in the case of circular radiators by vibrating in one of the axysymmetric modes thereof, displacing the internodal crowns in such a way that the distance from the center of said areas to the focal point is such that the radiation arrives in phase said point situated in the field close to the radiator.

23. An electroacoustic unit according to claim 1 and characterized because the electronic generating device produces in each instant a signal whose frequency is situated within the resonance band of the transducer system, and automatically corrects the value of said frequency to adapt it to the slipping that can be produced in the resonance band of the transmitter.

24. An electroacoustic unit according to claim 1 and characterized because the electronic generator has a power amplifier in which the phase displacement introduced between the input and output signals is null.

25. An electroacoustic unit according to claim 1 and characterized because in the electronic generator the channel for taking the sample of the load current signal is formed by a resistor in series with the load of the amplifier with a value that does not appreciably modify the load impedance the voltage in the terminals thereof being proportional to the current intensity in the load.

26. An electroacoustic unit according to claim 1 and characterized because in the electronic generator a sample of the output voltage of the power amplifier is taken by means of a voltage divider to control the power.

27. An electroacoustic unit according to claim 1 and characterized because the electronic generator includes a PLL (Phase Locked Loop) circuit integrated by a voltage controlled oscillator, a four-quadrant multiplier acting as a phase and low pass filter comparator.

28. An electroacoustic unit according to claim 1 and characterized because the voltage controlled oscillator of the electronic generator has two outputs, one in the form of a square wave which attacks the phase comparator and another sinewave that attacks the amplifier both out of phase in $\pi/2$ radians, the other input of the phase comparator being the output current sample signal.

29. An electroacoustic unit according to claim 1 and characterized because in the electronic generator the circuit measuring the power delivered to the load is formed by a four-quadrant multiplier whose inputs are the voltage and current samples taken at the output of the power amplifier, the product signal being filtered for low pass to obtain a signal proportional to the effective power in the load.

30. An electroacoustic unit according to claim 1 and characterized because in the electronic generator, the circuit controlling the power delivered to the load is made up of a comparator and four quadrant multiplier, operating as an attenuator controlled by voltage.

* * * * *